US006467984B1

(12) United States Patent
To

(10) Patent No.: US 6,467,984 B1
(45) Date of Patent: Oct. 22, 2002

(54) RING BINDER HAVING ACTUATING LEVER WITH CUSHION MEMBER

(75) Inventor: Chun Yuen To, Kauto Shan Shatin (HK)

(73) Assignee: World Wide Stationery Mfg. Co., Ltd., Kwai Chung (HK)

( * ) Notice: Subject to any disclaimer, the term of this patent is extended or adjusted under 35 U.S.C. 154(b) by 130 days.

(21) Appl. No.: 09/662,847

(22) Filed: Sep. 15, 2000

Related U.S. Application Data

(63) Continuation-in-part of application No. 09/539,712, filed on Mar. 31, 2000, now Pat. No. 6,364,558.

(51) Int. Cl.[7] ..... B42F 13/20
(52) U.S. Cl. ..... 402/38; 402/36; 402/41
(58) Field of Search ..... 402/4, 26, 31, 402/36–42; 128/206.27

(56) References Cited

U.S. PATENT DOCUMENTS

| | | | | |
|---|---|---|---|---|
| 5,234,276 A | | 8/1993 | Semerjian et al. | |
| 5,836,709 A | * | 11/1998 | Cheung | 402/38 |
| 6,280,114 B1 | * | 8/2001 | To | 402/38 |
| 6,364,558 B1 | * | 4/2002 | To | 402/38 |

* cited by examiner

*Primary Examiner*—William Fridie, Jr.
(74) *Attorney, Agent, or Firm*—Birch, Stewart, Kolasch & Birch, LLP

(57) ABSTRACT

A ring binder includes a substantially rigid curved upper plate supporting a pair of hinged leaves. A plurality of ring members are secured to the hinged leaves for engaging corresponding holes in sheets of material retained by the ring binder. An actuating lever is located at each end of the curved upper plate for actuating the hinged leaves to open and close the ring members. Each actuating lever includes a tab with a cushion member thereon. The cushion member extends over and surrounds the tab. The cushion member includes an opening in a lower wall thereof which extends into a slot in an interior of the cushion member. The opening allows the tab to pass freely therethrough and slip into the slot to attach the cushion member to the tab. The cushion member is engaged by the fingers of a user to pivot the actuating lever in order to move the ring members between the open position and the closed position. The cushion member is a soft pad of resilient material such as rubber or soft plastic. The cushion member provides improved tactile characteristics to the actuating lever, making the actuating lever comfortable to use. The cushion member also minimizes the feedback of undesirable shock forces produced by the snap action of the rings when opening and closing the rings.

20 Claims, 5 Drawing Sheets

RING BINDER HAVING ACTUATING LEVER WITH CUSHION MEMBER

This application is a Continuation-in-part of application Ser. No. 09/539,712, filed Mar. 31, 2000, now U.S. Pat. No. 6,364,558 the entire contents of which are hereby incorporated by reference.

BACKGROUND OF THE INVENTION

1. Field of the Invention

The present invention relates to a ring binder having an improved actuating lever for opening and closing rings of the ring binder, and more particularly, to an actuating lever having a cushion member for improving tactile characteristics of the actuating lever.

2. Description of the Background Art

Ring binders are known which have a substantially rigid upper plate supporting a pair of hinged leaves pivotally movable relative to each other. A number of half-rings are attached to each of the hinged leaves so that pivoting of the hinged leaves will open or close the half-rings in a snapping motion. This motion is caused by movement of actuating levers located at each end of the ring binder.

Conventional actuating levers are typically formed of stamped metal having sufficient rigidity to transmit the forces necessary to open and close the rings. However, the snapping action produces undesirable shock forces which are transmitted to the fingers of the user. Also, because the actuating levers are formed of metal which it typically nickel plated, the actuating levers can become slippery, causing the user's fingers to slip off of the actuating lever, possibly resulting in injury to the user. Additionally, conventional actuating levers have an outwardly turned lip around most of the perimeter to rigidify and reinforce the actuating lever. This edge of the lip can be sharp and uncomfortable to press with the fingers when attempting to close the rings.

One attempt has been made to provide a cover for an actuating lever, as shown in U.S. Pat. No. 5,234,276. The purpose of the cover therein is to make metal actuating levers easier on the fingers of the binder operator and/or to make the actuating levers longer so that more leverage is available. The cover is formed of two hinged plastic pieces that are snapped together to completely encase the actuating lever. Unfortunately, the plastic cover is susceptible to breakage, especially the tiny interlocking studs which hold the two halves together. The hinge can provide sharp edges, especially at the corners, and the seam between the mating halves can collect dirt and dust. Also, the hinge is susceptible to breakage. In addition, the cover is rigid, and rather large and cumbersome, approximately three times the size of the actuating lever, resulting in an unpleasant appearance.

There is a need in the art for a ring binder having actuating levers which are comfortable to use and slip resistant, and which minimize the feedback of undesirable shock forces produced by the snap action of the rings when opening and closing the rings.

SUMMARY OF THE INVENTION

The present invention fulfills the aforementioned need in the art by providing a ring binder including a substantially rigid curved upper plate supporting a pair of hinged leaves. A plurality of ring members are secured to the hinged leaves for engaging corresponding holes in sheets of material retained by the ring binder. An actuating lever is located at each end of the curved upper plate for actuating the hinged leaves to open and close the ring members.

Each actuating lever includes a tab with a cushion member thereon. The cushion member extends over and surrounds the tab. The cushion member includes an opening in a lower wall thereof which extends into a slot in an interior of the cushion member. The opening allows the tab to pass freely therethrough and slip into the slot to attach the cushion member to the tab.

The cushion member is engaged by the fingers of a user to pivot the actuating lever in order to move the ring members between the open position and the closed position. The cushion member is a soft pad of resilient material such as rubber or soft plastic. The cushion member provides improved tactile characteristics to the actuating lever, making the actuating lever comfortable to use. The cushion member also minimizes the feedback of undesirable shock forces produced by the snap action of the rings when opening and closing the rings.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein.

DETAILED DESCRIPTION OF THE PREFERRED EMBODIMENT

Figure 1:
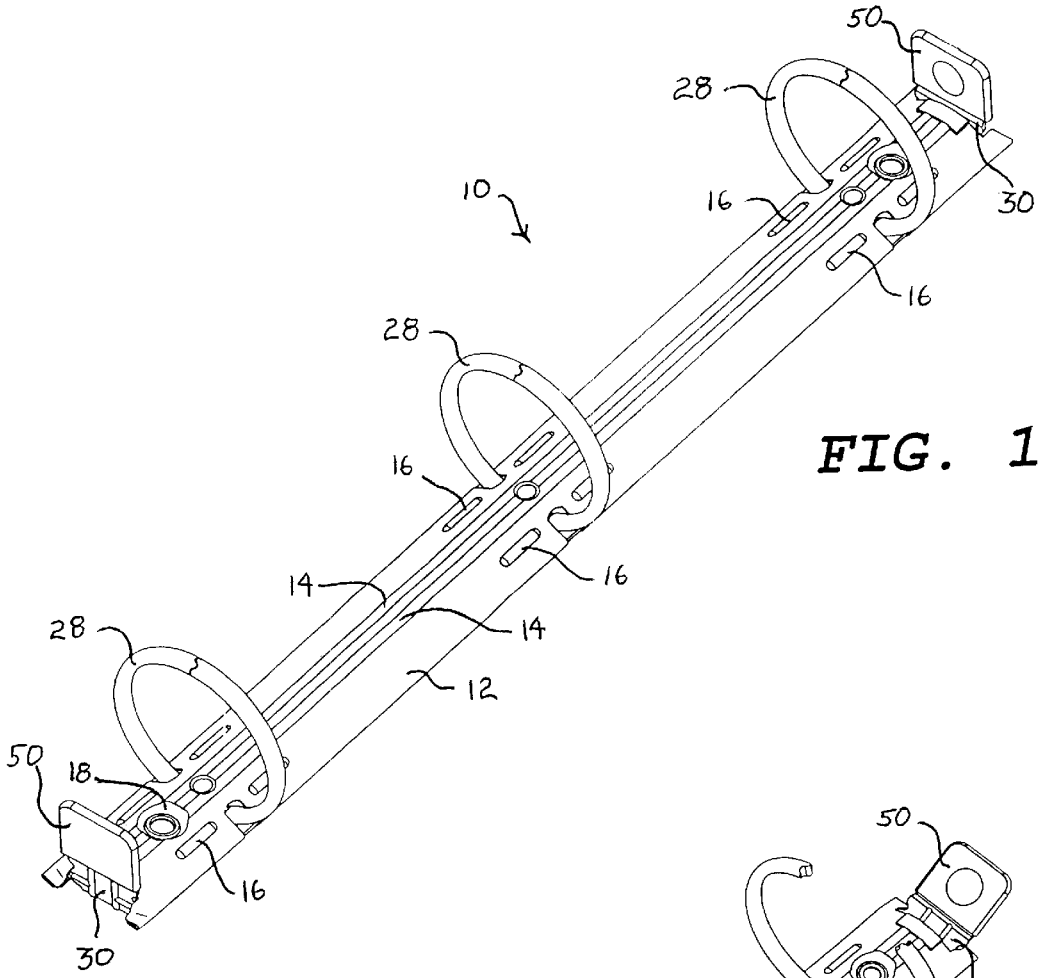
FIG. 1 is a perspective view showing the upper side of the ring binder of the present invention with the rings in a closed position.
Figure 2:
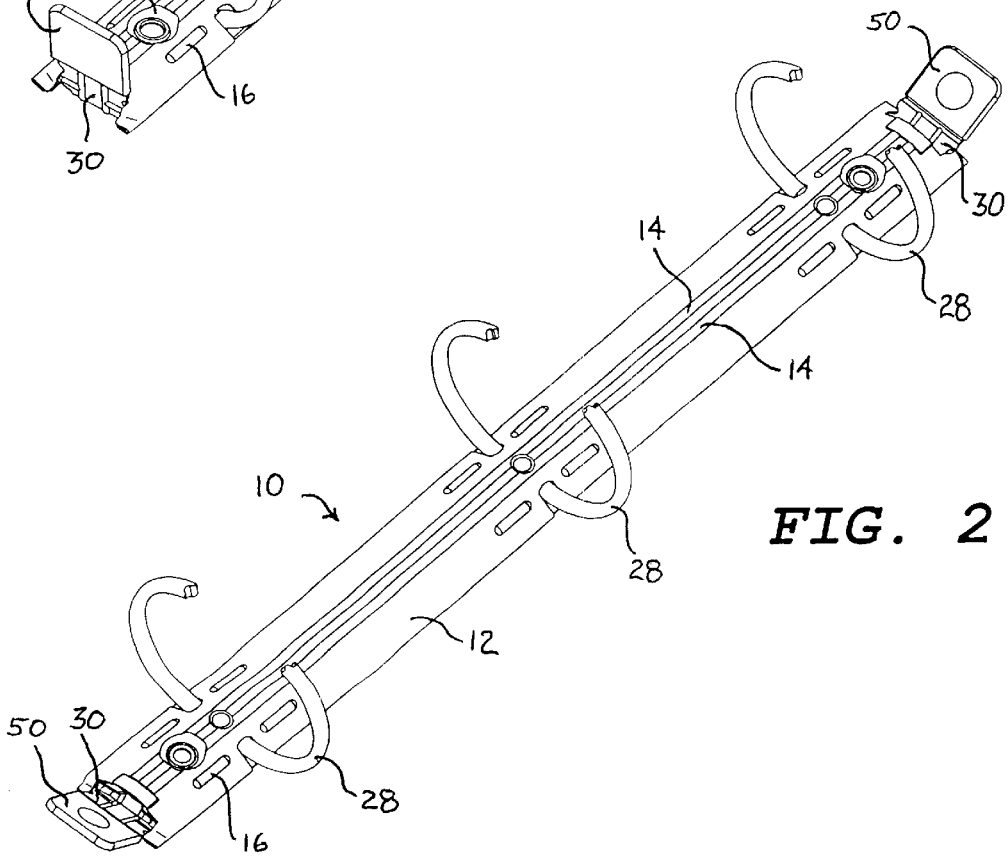
FIG. 2 is a perspective view showing the upper side of the ring binder of the present invention with the rings in an open position.
Figure 3:
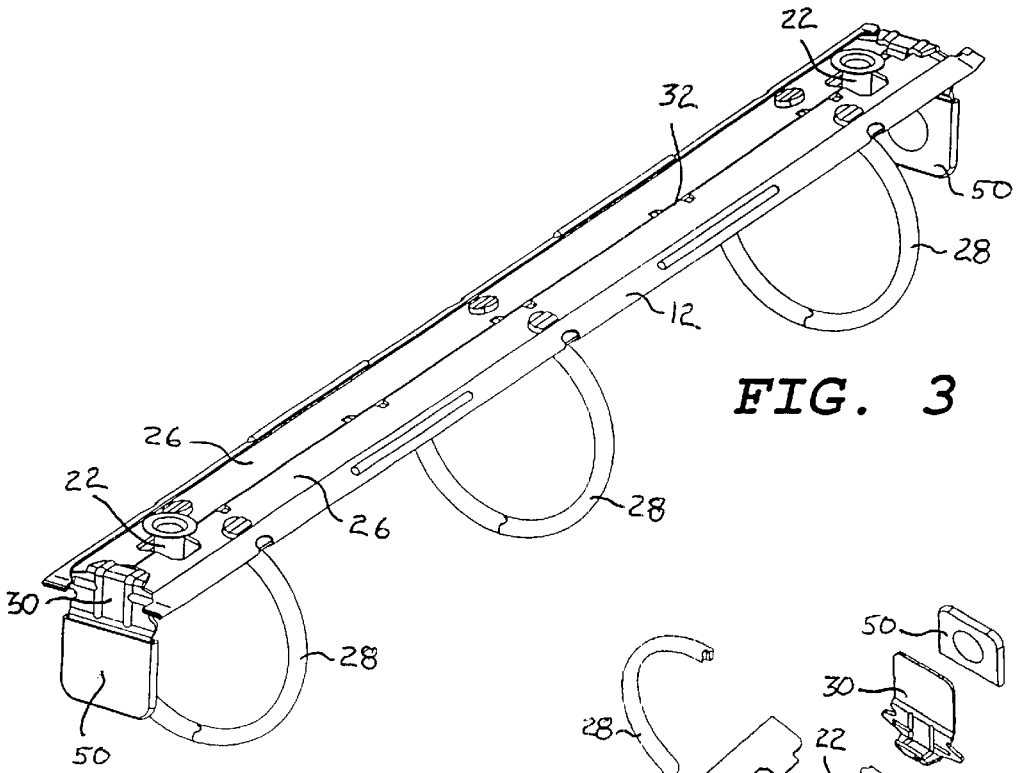
FIG. 3 is a perspective view showing the underside of the ring binder.
Figure 4:
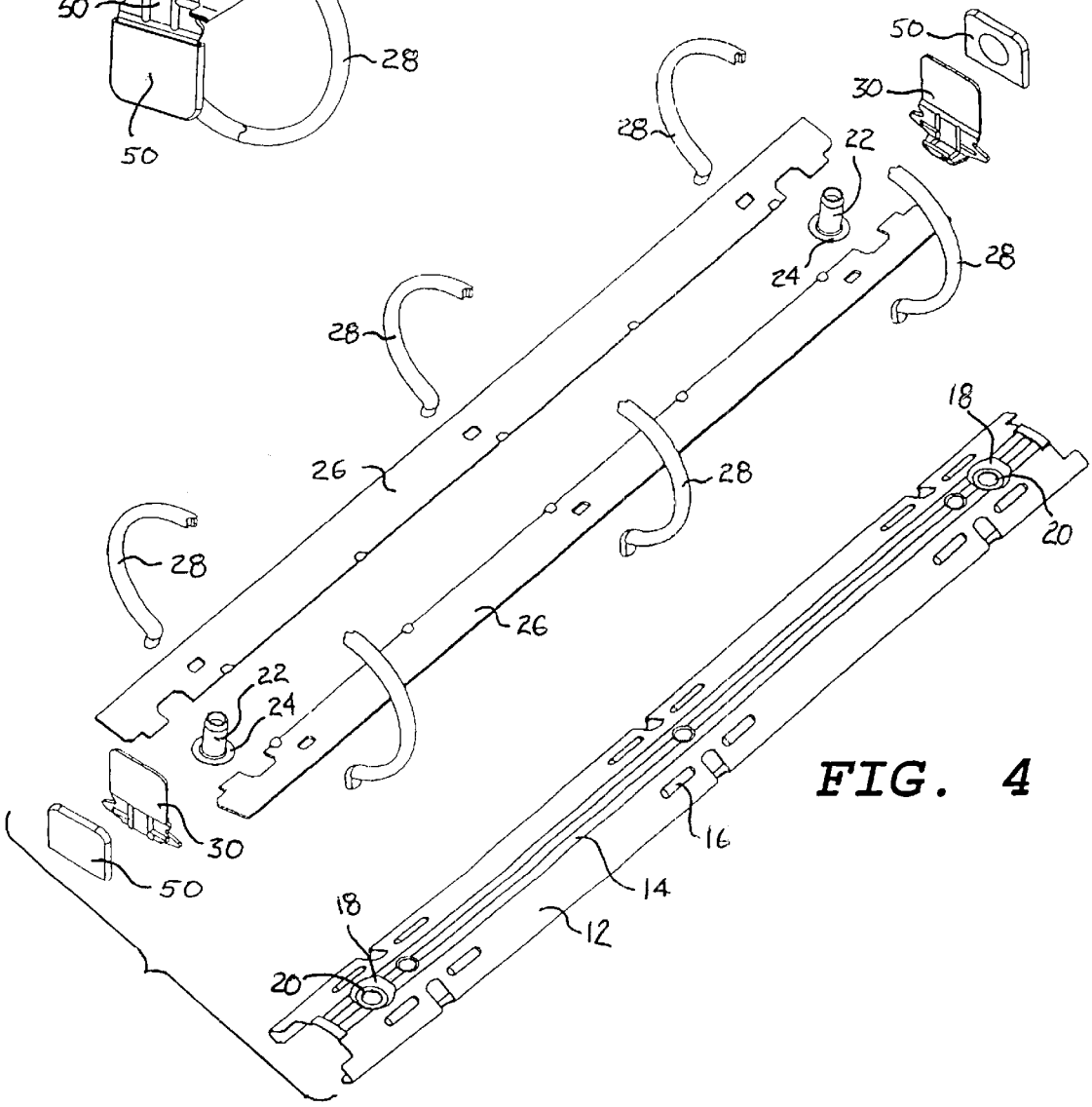
FIG. 4 is an exploded perspective view of the ring binder.
Figure 5:
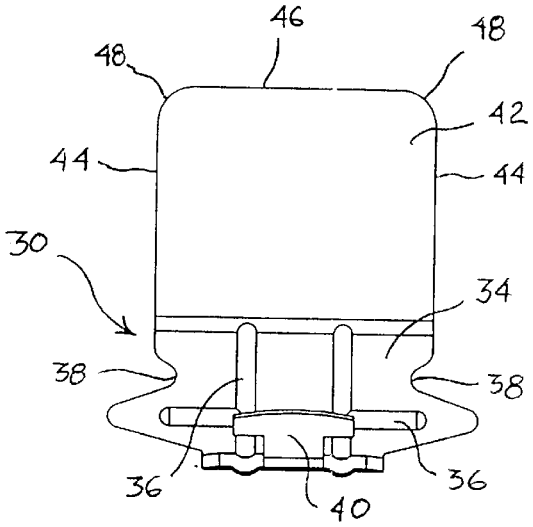
FIG. 5 is a front view of the inner side of an actuating lever of a first embodiment with a cushion member removed therefrom.
Figure 6:
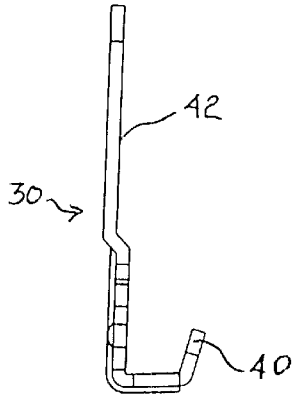
FIG. 6 is a side view of the actuating lever of the first embodiment with the cushion member removed therefrom.

Referring in detail to the drawings, and with particular reference to FIGS. 1–4, a ring binder of the present invention is shown. The ring binder 10 is securable to a cover member (not shown) to produce a loose-leaf binder. The cover member preferably includes a spine located between front and back covers of the cover member. The ring binder 10 may be attached to the cover member by any conventional fasteners, such as rivets, which extend through the cover member and which are deformed, for example, by punching, to securely and permanently fix the ring binder 10 to the cover member.

The ring binder 10 includes a substantially rigid curved upper plate 12. The curved upper plate 12 includes a pair of first reinforcing ribs 14 extending longitudinally along the center thereof which protrude upwardly and outwardly from an outer surface of the curved upper plate 12, thereby increasing the resistance of the curved upper plate 12 to bending. The first ribs 14 extend substantially along the entire length of the curved upper plate 12 from one end to another. The curved upper plate 12 further includes several pairs of second ribs 16 which protrude upwardly and outwardly from an outer surface of the curved upper plate 12 and which are located outwardly of the first ribs 14.

The curved upper plate 12 further includes a depression 18 near each end thereof. Each depression 18 includes an aperture 20 extending through the curved upper plate 12. A cylindrical post 22 is attached to the curved upper plate 12 at the depression 18. One end of the cylindrical post 22 is secured within the aperture 20, for example, by pressing. The other end of the cylindrical post 22 has a flange 24 which forms a base for the ring binder 10 for attachment to the cover.

A pair of hinged leaves 26 are supported by the curved upper plate 12. The curved upper plate 12 provides a biasing force on the hinged leaves 26 such that the hinged leaves 26 move in an overcenter manner. A plurality of ring members 28 are secured to the hinged leaves 26 for engaging corresponding holes in sheets of material retained by the ring binder 10.

An actuating lever 30 is located at each end of the curved upper plate 12 for actuating the hinged leaves 26 to open and close the ring members 28. When the ring members 28 of the ring binder 10 are in a closed position, movement of the actuating levers 30 away from one another causes a central hinge portion 32 of the hinged leaves 26 to move toward the curved upper plate 12, thereby causing the ring members 28, which move with the hinged leaves 26, to move to an open position. Conversely, when the ring members 28 of the ring binder 10 are in an open position, movement of the actuating levers 30 toward one another causes the central hinge portion 32 of the hinged leaves 26 to move away from the curved upper plate 12, thereby causing the ring members 28 to return to the closed position. A known ring binder including a conventional opening/closing mechanism with an actuating lever is more fully disclosed in U.S. Pat. No. 5,354,142, the entire contents of which are hereby incorporated by reference.

Referring now to FIGS. 5–14, an actuating lever 30 of the present invention is shown, which includes a main body 34 made of metal having a nickel plated finish. Each actuating lever 30 includes a plurality of reinforcing ribs 36 thereon to increase the rigidity of the main body 34. The main body 34 further includes a pair of grooves 38 on opposite side edges which form a pivot axis of the actuating lever 30. A lower portion of the main body 34 includes a hook member 40 which engages and moves the hinged leaves 26. An upper portion of the main body 34 is the portion engaged by the fingers of the user to pivot the actuating lever 30 about the pivot axis defined by the grooves 38, in order to open and close the ring members 28 of the ring binder 10.

The upper portion of the main body 34 includes a substantially flat tab 42 having a shape which is trapezoidal, and preferably generally rectangular. In the first embodiment shown in FIGS. 5–10, the tab 42 includes a pair of straight side edges 44 which are parallel with one another, and a top edge 46 interconnecting upper ends of the side edges 44. A pair of radius portions 48 are located at the junctions between the top edge 46 and the side edges 44 of the tab 42.

Figure 7:
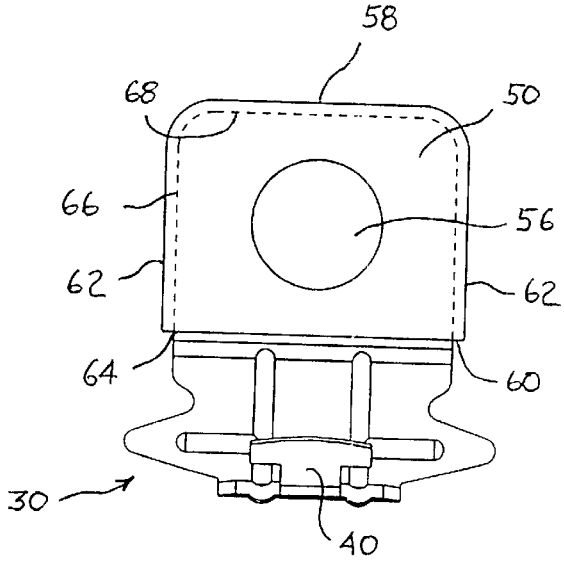
FIG. 7 is a front view of the inner side of the actuating lever of the first embodiment with the cushion member thereon.

Referring now to FIGS. 7–10, a cushion member 50 of the present invention is shown. The cushion member 50 generally surrounds the tab 42 and is preferably only slightly larger than the size of the tab 42, as shown in FIG. 7. The cushion member 50 is large enough to cover the tab 42 so that the user's fingers do not touch any rough edges which may exist on the tab 42, but instead touch the soft flat face of the cushion member 50. The cushion member 50 is a soft pad of resilient material, which is preferably formed of rubber or soft plastic.

Figure 8:
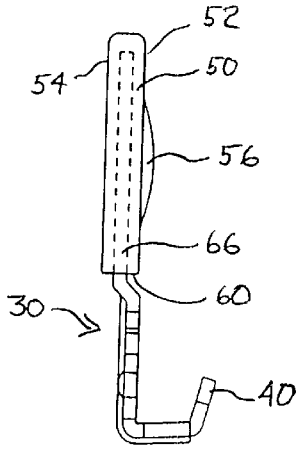
FIG. 8 is a side view of the actuating lever of the first embodiment with the cushion member thereon.

As shown in FIGS. 7 and 8, the cushion member 50 is generally trapezoidal in shape, and preferably generally rectangular. The cushion member 50 has an inner face 52 and an outer face 54. The inner face 52 refers to the face closest to the rings 28 when the cushion member 50 is installed on the tab 42, and the outer face 54 refers to the face furthest from the rings 28 when the cushion member 50 is installed on the tab 42. The inner face 52 is engaged by the finger of a user to pivot the actuating lever 30 to move the ring members 28 to the open position, and the outer face 54 is engaged by the finger of a user to pivot the actuating lever 30 to move the ring members 28 to the closed position.

A convex projection 56 is located on the inner face 52 of the cushion member 50. The outer face 54 of the cushion member 50 has a substantially flat face. The cushion member 50 further includes an upper wall 58, a lower wall 60, and a pair of side walls 62. An opening 64 is located in the lower wall 60 and extends into a slot 66 in the body of the cushion member 50. The slot 66 forms a generally rectangular cavity in the cushion member 50. The width of the slot 66 is approximately equal to or slightly smaller than the distance between the side edges 44 of the tab 42.

Figure 10:
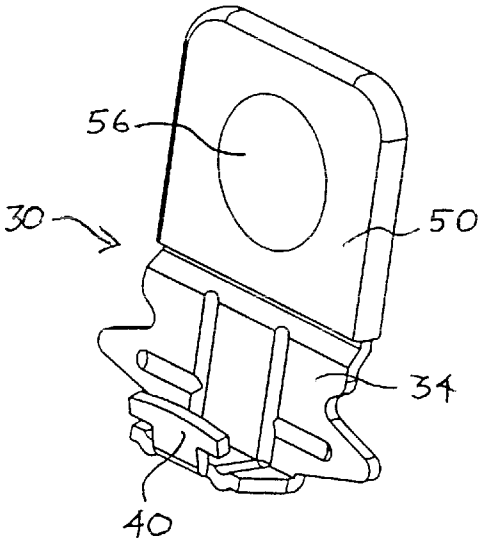
FIG. 10 is a perspective view of the inner side of the actuating lever of the first embodiment with the cushion member assembled thereto.
Figure 9:
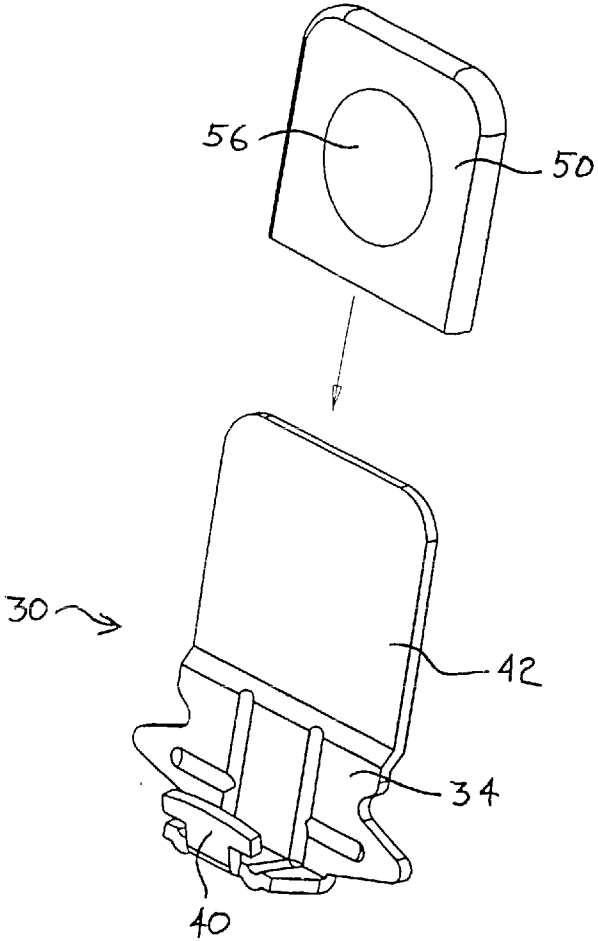
FIG. 9 is an exploded perspective view of an inner side of the actuating lever of the first embodiment with the cushion member being assembled therewith.
Figure 11:
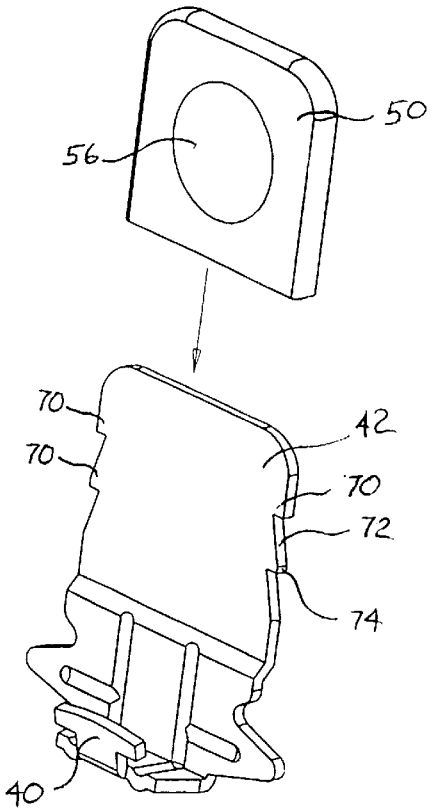
FIG. 11 is an exploded perspective view of an inner side of an actuating lever of a second embodiment with a cushion member being assembled therewith.
Figure 12:
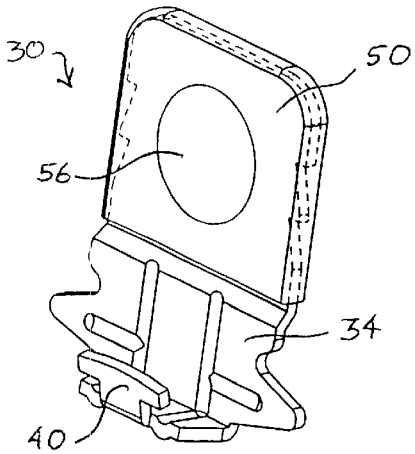
FIG. 12 is a perspective view of the inner side of the actuating lever of the second embodiment with the cushion member assembled thereto.
Figure 13:
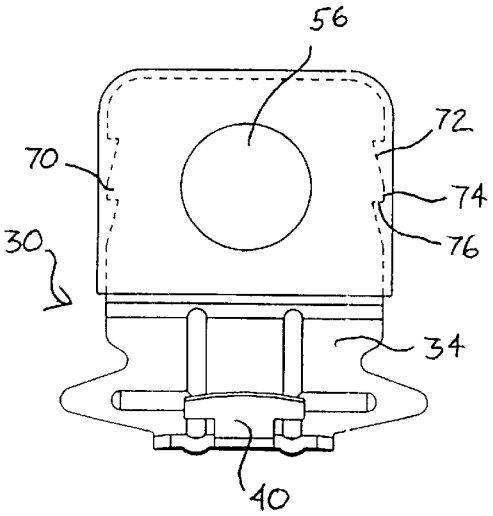
FIG. 13 is a front view of the inner side of the actuating lever of the second embodiment with the cushion member thereon.
Figure 14:
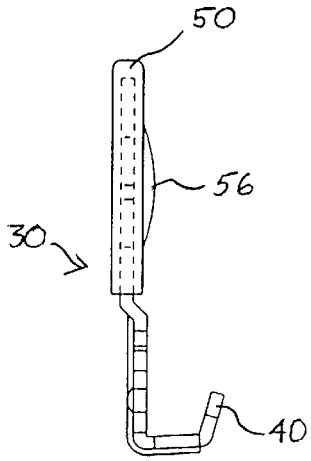
FIG. 14 is a side view of the actuating lever of the second embodiment with the cushion member thereon.

As shown in FIGS. 9 and 10, to install the cushion member 50, the tab 42 passes freely through the opening 64 and slides into the slot 66 of the cushion member 50. The cushion member 50 is pressed downwardly onto the tab 42 until the top edge of the tab 42 is seated against the an end 68 of the slot 66.

The cushion member 50 is preferably retained on the tab 42 by the frictional engagement between the interior surfaces of the slot 66 and the exterior surface of the tab 42. To increase this frictional engagement, the interior surface of the slot 66 is preferably a flat planar surface to maximize the surface contact between the slot 66 and the tab 42. Also, where the cushion member 50 is formed of a resilient material such as rubber or an elastomer, the frictional contact is enhanced to prevent slippage of the cushion member 50 off of the tab 42. If necessary, an adhesive can be used to assist in the securement of the cushion member 50 on the tab 42.

Referring now to FIGS. 11–14, a second embodiment of the present invention is shown. In this embodiment, the side edges 44 of the tab 42 include a plurality of barbs or hook members 70. Each hook member 70 includes an outwardly-inclined forward portion 72 terminating at a point 74, and a non-inclined rearward portion 76 extending inwardly from the point 74. The rearward portion 76 is substantially parallel to the top edge 46 of the tab 42. Each side edge 44 of the tab 42 preferably includes two hook members 70, although fewer or more hook members 70 may be used.

The hooks members 70 are configured so that the cushion member 50 may be easily placed on the tab 42. Once the cushion member 50 is placed on the tab 42, the points 74 of the hook members 70 will embed into the inner walls of the slot 66 to retain the cushion member 50 on the tab 42. The inner walls of the slot 66 may be flat, or may include correspondingly shaped hook-receiving indentations to assist in securing the cushion member 50 to the tab 42.

The cushion member 50 of the present invention is preferably provided on the actuating lever 30 at the time of manufacture of the ring binder 10. Alternatively, the cushion member 50 may be applied to the tab 42 at any time by a user if so desired.

Although the cushion member 50 is preferably formed of rubber or soft plastic, it is conceived that other cushioning materials such as leather or dense foam may be utilized. Also, the cushion member 50 may be formed of different colors to coordinate the ring binder 10 with the cover member, or with the subject matter of the items contained within the loose-leaf binder. In the present invention, the cushion member 50 is preferably formed as a one-piece unitary integral member.

Although the main body 34 of the actuating lever 30 is made of stamped metal having a nickel plated finish, it is possible to utilize other suitable strong and rigid materials, such as plastic, without departing from the invention.

It should be understood that while the preferred embodiment describes the ring binder 10 as being attached to the spine of the cover member, the ring binder may instead be attached to the front cover or the back cover. Also, although three ring members 28 are shown in FIGS. 1–4, it should be understood that any number and arrangement of ring members 28 may be utilized. For example, two or four ring members may be utilized. Also, the ring members 28 may be equally spaced-apart, or may have different spacings. Finally, although the ring members 28 shown are circular, it is envisioned that D-shaped or other ring shapes may be utilized.

Although the actuating lever cushion member 50 of the present invention has been described for use with a ring binder having a curved upper plate 12 with a pair of first reinforcing ribs 14 and several pairs of second ribs 16, it should be understood that the actuating lever cushion member 50 may be used with differently shaped upper plates which do not include reinforcing ribs.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A ring binder comprising:

an upper plate;

a pair of hinged leaves supported by said upper plate;

a plurality of rings attached to said hinged leaves and movable therewith;

at least one pivotable actuating lever for moving said hinged leaves from a first position where said rings are closed, to a second position where said rings are open, said actuating lever including a tab at an upper end portion thereof; and a cushion member extending over and surrounding said tab, said cushion member including an opening in a lower wall thereof which extends into a slot in an interior of said cushion member, said opening allowing said tab to pass freely therethrough and slip into said slot to attach said cushion member to said tab.

2. The ring binder according to claim 1, wherein said cushion member is formed of rubber or soft plastic.

3. The ring binder according to claim 1, wherein said cushion member is formed as a one-piece unitary integral member.

4. The ring binder according to claim 1, wherein an interior surface of said slot and an exterior surface of said tab are each substantially flat to increase surface contact between said slot and said tab to promote frictional engagement between said interior surface of said slot and said exterior surface of said tab.

5. The ring binder according to claim 1, wherein said cushion member is generally trapezoidal and has an inner face and outer face.

6. The ring binder according to claim 5, wherein said inner face of said cushion member has a substantially flat face having a convex protrusion extending outwardly therefrom.

7. The ring binder according to claim 1, wherein said tab includes a pair of side edges which are parallel with one another, and a top edge interconnecting upper ends of the side edges.

8. The ring binder according to claim 7, wherein said side edges of said tab include at least one hook member.

9. The ring binder according to claim 8, wherein said hook member includes an outwardly-inclined forward portion terminating at a point, and a non-inclined rearward portion extending inwardly from said point.

10. The ring binder according to claim 1, wherein said tab includes an inner face, an outer face, a pair of side edges, and a top edge interconnecting upper ends of the side edges, and said cushion member is a one-piece unitary generally rectangular member made of resilient material, said cushion member including a slot in a lower wall thereof which extends into an interior of said cushion member, said tab being insertable into said slot so that said cushion member extends over and surrounds said inner face, said outer face, said pair of side edges, and said top edge of said tab.

11. In combination, a ring binder having a pivotable actuating lever including a tab at an upper end portion thereof, and a cushion member extending over and surrounding said tab, said cushion member including an opening in a lower wall thereof which extends into a slot in an interior of said cushion member, said opening allowing said tab to pass freely therethrough and slip into said slot to attach said cushion member to said tab.

12. The combination according to claim 11, wherein said cushion member is formed of rubber or soft plastic.

13. The combination according to claim 11, wherein said cushion member is formed as a one-piece unitary integral member.

14. The combination according to claim 11, wherein an interior surface of said slot and an exterior surface of said tab are each substantially flat to increase surface contact between said slot and said tab to promote frictional engagement between said interior surface of said slot and said exterior surface of said tab.

15. The combination according to claim 11, wherein said cushion member is generally trapezoidal and has an inner face and outer face.

16. The combination according to claim 15, wherein said inner face of said cushion member has a substantially flat face having a convex protrusion extending outwardly therefrom.

17. The combination according to claim 11, wherein said tab includes a pair of side edges which are parallel with one another, and a top edge interconnecting upper ends of the side edges.

18. The combination according to claim 17, wherein said side edges of said tab include at least one hook member.

19. The combination according to claim 18, wherein said hook member includes an outwardly-inclined forward portion terminating at a point, and a non-inclined rearward portion extending inwardly from said point.

20. The combination according to claim 11, wherein said tab includes an inner face, an outer face, a pair of side edges, and a top edge interconnecting upper ends of the side edges, and said cushion member is a one-piece unitary generally rectangular member made of resilient material, said cushion member including a slot in a lower wall thereof which extends into an interior of said cushion member, said tab being insertable into said slot so that said cushion member extends over and surrounds said inner face, said outer face, said pair of side edges, and said top edge of said tab.

* * * * *